US005529198A

United States Patent [19]

Reynard

[11] Patent Number: 5,529,198

[45] Date of Patent: Jun. 25, 1996

[54] HINGEDLY MOUNTED DOOR ON CONTAINER

[76] Inventor: Kenneth Reynard, Unit 1 South Church Enterprise Park, Bishop Auckland Co Durham DL14 6XB, Great Britain

[21] Appl. No.: 170,178

[22] PCT Filed: Jun. 18, 1992

[86] PCT No.: PCT/GB92/01100

§ 371 Date: May 31, 1994

§ 102(e) Date: May 31, 1994

[87] PCT Pub. No.: WO92/22721

PCT Pub. Date: Dec. 23, 1992

[30] Foreign Application Priority Data

Jun. 18, 1991 [GB] United Kingdom ..... 9113189

[51] Int. Cl.[6] ..... B65D 90/54

[52] U.S. Cl. ..... 220/1.5; 220/343; 16/251

[58] Field of Search ..... 16/225, 251, 355, 16/390; 220/1.5, 343, 323

[56] References Cited

U.S. PATENT DOCUMENTS

| | | | |
|---|---|---|---|
| 1,946,619 | 2/1934 | Furman et al. | 285/159 |
| 2,531,066 | 11/1950 | Lynch | 220/343 |
| 3,570,698 | 3/1971 | Dougherty | 220/1.5 |
| 4,057,170 | 11/1977 | Dougherty | 220/323 |
| 4,177,907 | 12/1979 | Funaioli et al. | 220/1.5 |

FOREIGN PATENT DOCUMENTS

| | | |
|---|---|---|
| 2617743 | 1/1989 | France . |
| 2248164 | 4/1974 | Germany . |
| 2260508 | 4/1993 | United Kingdom . |

*Primary Examiner*—Stephen J. Castellano
*Attorney, Agent, or Firm*—Workman, Nydegger & Seeley

[57] ABSTRACT

A hinge which serves to hingedly mount a door on an upright member of a rectangular frame which defines an opening into a container. The hinge has a seating portion that is capable of attachment to the outer face of the door and a two-part offset portion carrying a pivot mounting that forms an offset hinge axis which enables the door to move to a closed position within the plane of the opening defined by the frame. The offset portion has a first part which adjoins the seating portion at a neck region and which is stepped with respect to the seating portion to define a shallow recess between the underside of the offset portion and the outer face of the door into which a flange portion of a door edge seal can be received. The second part of the offset portion extends outwardly away from the first part to carry the pivot mounting which forms the offset hinge axis. A groove is formed in the neck region of the seating portion opening towards the face of the door, and a port communicating with the groove is formed in the hinge opening away from the outer face of the door. A sealant can be injected into the groove through the port to provide a sealant barrier along the interface between the neck region and the face of the door preventing ingress of moisture to the underside of the hinge.

15 Claims, 4 Drawing Sheets

HINGEDLY MOUNTED DOOR ON CONTAINER

This invention relates to a container having side walls, a loading/unloading opening at one end of the container, a rectangular frame defining the opening, and at least one door hingedly mounted on said frame to move between open and closed positions with respect to said opening.

The invention has been developed primarily, though not exclusively, in connection with metal walled containers of the type used as shipping containers, road cargo box vans and the like, and in which there is usually provided a pair of swing doors at the loading/unloading end of the container, each of which doors is hingedly mounted on a respective upright part of the frame, and which are locked together in their closed positions by means of a common locking mechanism.

However, the invention is not restricted solely to metal walled containers, or to provision of double doors at the loading/unloading end, and will include a container having a single closure door and side walls made of nonmetallic material, provided that a rigid rectangular frame is arranged at the loading/unloading end onto which the door is hingedly mounted.

The hinges used conventionally for mounting closure doors on containers have a flat seating portion with a seating face to engage the outer face of the door, and an off-set portion carrying a pivot mounting by means of which the hinge can be hingedly mounted on a corresponding upright frame member of the frame. The off-set portion extends outwardly away from the seating portion to provide an off-set (substantially vertical) hinge axis i.e. spaced horizontally away from the frame, so that the door can move to a closed position in which it is flush with the frame i.e. fits within the opening of the frame in the general plane thereof.

Further, it is usual to provide a flexible door seal along the edge of the door, which provides a seal between this edge of the door and the adjacent upright frame member when the door is in the closed position. This seal is usually T-shaped, as seen in section, with the stem of the T being located between the edge of the door and the inner face of the frame member, and with part of the flange or cross piece of the T being located so as to overlie part of the front face of the door and to cover the gap between the door edge and the frame member in the closed position of the door.

In order to provide a housing into which the flange of the door seal can be received, it is usual for the off-set portion of the hinge to be in two parts, a first part of which extends generally parallel to the seating portion but spaced laterally therefrom i.e. stepped, to define a shallow recess in which the flange can be received. A second part of the off-set portion extends outwardly at an angle to the first part and carries the pivot mounting for the off-set hinge axis.

In the case of doors of laminated construction, namely wooden ply/metal laminations, it is usual for the door hinges to be secured to the face of the door, near to the hinged side of the door, by means of bolts taken through the seating portion, whereas for doors made of steel it is usual for the hinges to be welded in position.

Regardless of the method used to secure the hinges to the door face, there are problems in providing a satisfactory degree of sealing of the inside (seating) face of the hinges against ingress of moisture, and particularly in the so-called "neck" region of a hinge, which is the transition region between the flat seating face and the first part of the off-set portion. Failure to provide a satisfactory seal in this region enables moisture to come into contact with, and to remain in contact with the metal of the hinge in this area, and also with the face of the door. Even in the case of a laminated door, the face is made of metal, and inadequate sealing of the "neck" region of existing designs of hinge provide a corrosion site which over a period of time can result in an unacceptable level of corrosion of the hinges and/or door face occurring.

The present invention addresses this problem and seeks to provide a solution whereby improved sealing of the vulnerable neck region of the hinges can be obtained in a simple and reliable manner.

According to the invention there is provided a container having side walls, a loading/unloading opening at one end of the container, a rectangular frame defining said opening and having a pair of upright parallel frame members and upper and lower transversely extending frame member, at least one door hingedly mounted on one of said upright frame members for movement between an open position and a closed position within the general plane of the frame, and a set of hinges mounted on the outer face of the door near to the side of the door facing said one upright frame member, each hinge having a seating portion to engage the face of the door and a two part off-set portion carrying a pivot mounting to form an off-set hinge axis and of which a first part is stepped with respect to the seating portion to define a shallow recess in which a flange of a door edge seal can be received and which adjoins the seating portion via a neck region of the hinge, and a second part of which extends outwardly away from the first part and carries the pivot mounting to provide said off-set hinge axis, in which:

- a groove is formed in said neck region of the seating portion and which is open towards the face of the door; and,
- a port is formed in the outer face of the hinge and which communicates with said groove, whereby a sealant can be injected into the groove from externally of the hinge via said port so as to provide a sealant barrier along the neck region of the hinge.

Preferably, each hinge is secured at a required position on the door face by means of a welded connection, when the door is made of steel, and which is formed by a weld taken along at least the major part of the outer periphery of the seating portion.

The seating portion preferably comprises a curved nose of the hinge, in which case the weld is generally U-shaped, and with the sealant barrier extending across the seating portion and overlying the ends of the weld so as to provide a barrier to ingress of moisture coming into contact with the underside of the seating portion. This has the particular advantage that the structural integrity of the weld is not impaired in any highly stressed region, while providing a satisfactory seal against ingress of moisture.

The port may be formed in the outer face of the seating portion, and have direct communication with the groove.

The groove may extend generally parallel to the hinge axis, so that the injected sealant form an end closure line defining one edge of the seating face of the seating portion, and preferably outlets are provided at each end of the groove so that emission of sealant can be observed during injection of sealant to provide assurance that a sufficient amount has been introduced to fill the space between the groove and the face of the door.

To provide a satisfactory weather proof seal in the gap between the hinge side of the door and the adjacent upright frame member, preferably a generally T-shaped door seal is mounted along the edge of the door, with the cross-piece of the T-section having a flange portion seated within a recess defined between the first part of each hinge and the door face, and a further part of the cross piece overlying the entrance to this gap when the door is in the closed position.

One embodiment of container according to the invention will now be described in detail, by way of example only, with reference to the accompanying drawings, in which.

Figure 1:
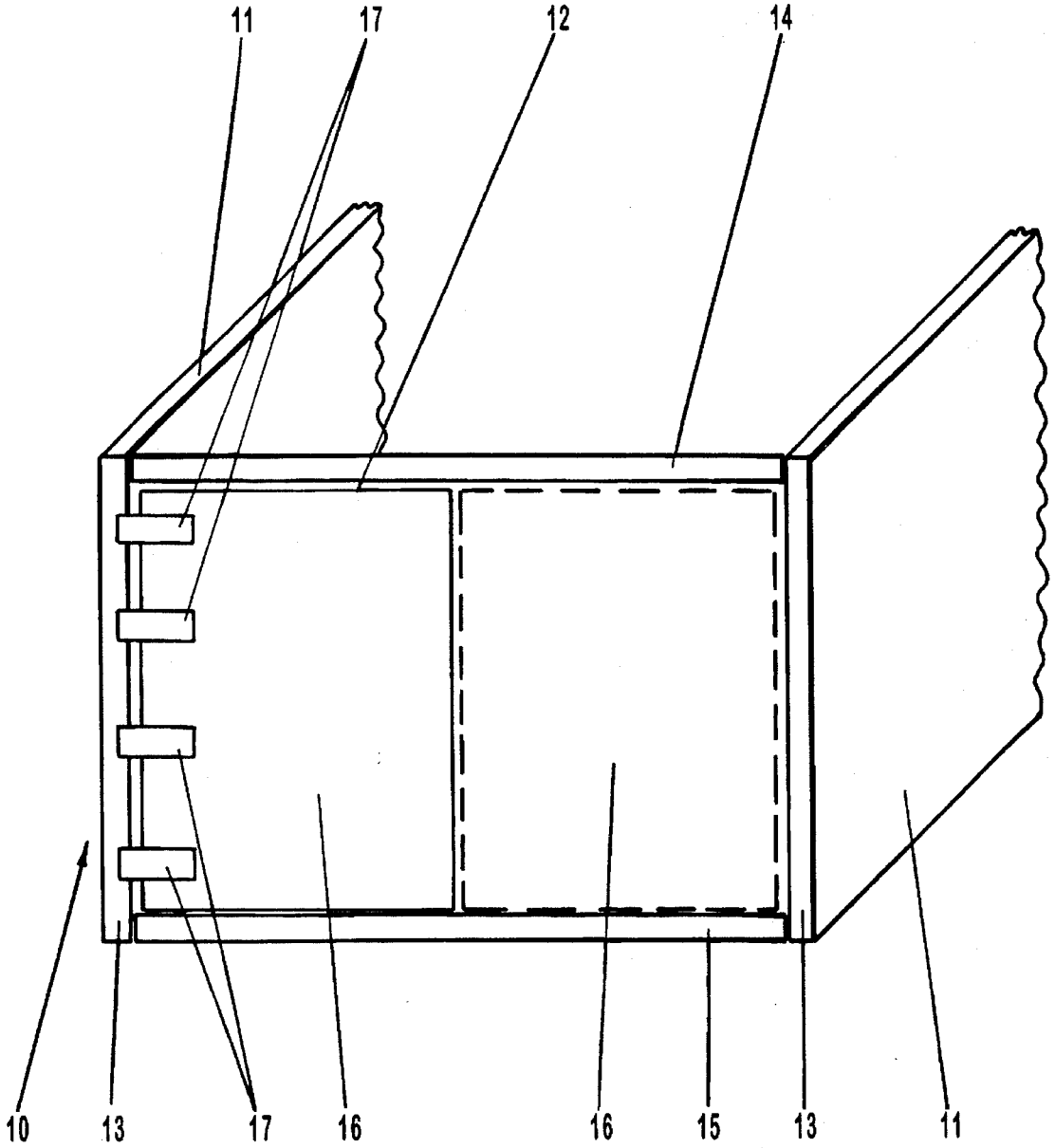
FIG. 1 is a perspective and schematic illustration of the loading/unloading opening end of a container with a pair of swing closure doors mounted hingedly on a rigid rectangular frame defining this opening.

Referring now to the drawings, there will be described a preferred embodiment of container according to the invention, which may comprise a metal walled container of the type used as a shipping container, a road cargo box van or the like, with FIG. 1 showing schematically the arrangement of closure doors at a loading/unloading end of the container. The container is designated generally by reference 10 and comprises a pair of opposed side walls 11, a loading/unloading opening 12 at one end of the container, a rectangular frame defining the opening 12 and comprising a pair of upright parallel frame members 13 and upper and lower transversely extending frame members 14 and 15, and at least one door hingedly mounted on the frame for movement between an open position and a closed position. In the illustrated embodiment, a pair of closure doors 16 is provided, each being hingedly mounted to a respective one of the upright frame members 13 for movement between an open position (not shown) and a closed position within the general plane of the frame i.e. located flush with the surfaces of the frame members 13 to 15. A locking mechanism (not shown) is provided to lock the doors 16 in the closed position.

Figure 2:
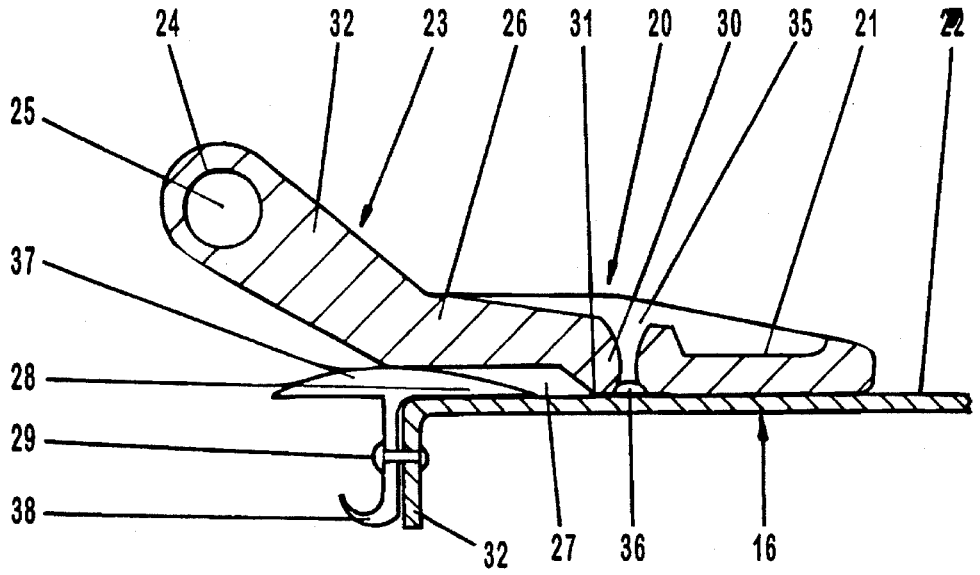
FIG. 2 is a schematic horizontal sectional view of a hinge according to the invention for use in hingedly mounting the doors on the upright frame members defining the loading/unloading opening.
Figure 3:
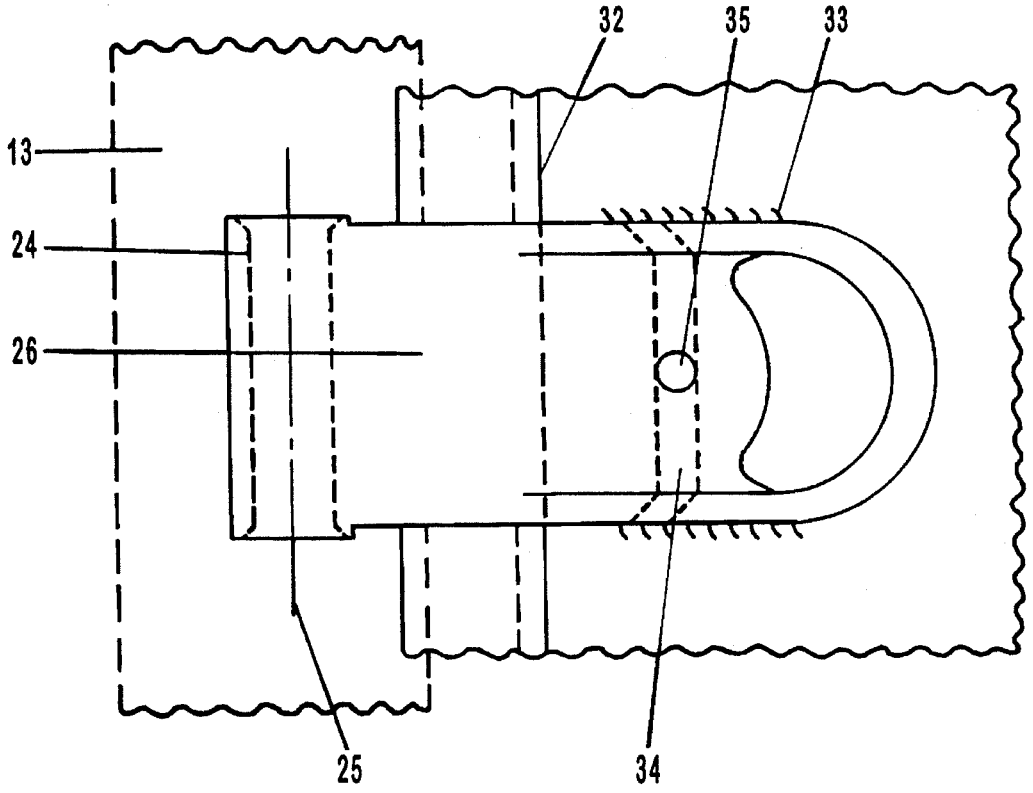
FIG. 3 is a detailed view, to an enlarged scale, and showing schematically the securement of the hinge to the door face adjacent its hinged side.
Figure 4:
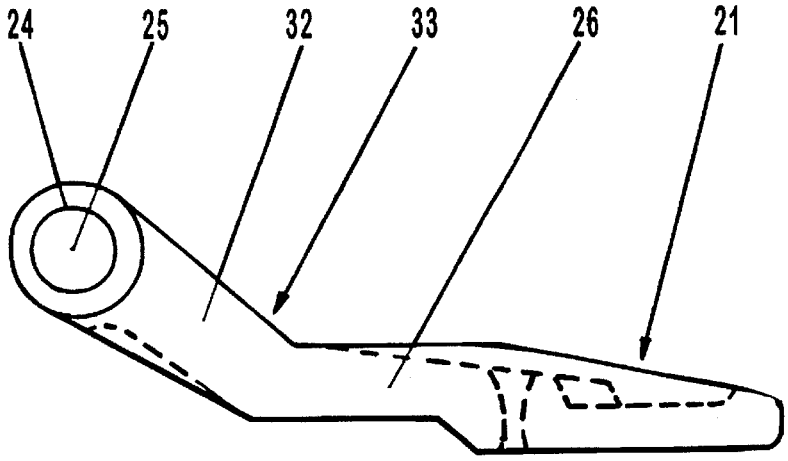
FIG. 4 is a view, similar to FIG. 2, showing in detail a practical embodiment of hinge made of forged steel for use in a container according to the invention.

FIG. 1 shows schematically only a set of hinges 17 for mounting each door on the frame, and FIGS. 2 and 3 show schematically in more detail a preferred construction of hinge, whereas FIGS. 4 to 7 show in detail a practical construction of forged door hinge for use in a particularly preferred embodiment of the invention.

Referring now to FIGS. 2 and 3, a one-piece or unitary hinge is designated generally by reference 20 and comprises a seating portion 21 to engage the face 22 of door 16, and a two part off-set portion 23 which carries a pivot mounting 24 to form an off-set hinge axis 25. The purpose of the off-set hinge axis 25 is to enable door 16 to pivot outwardly to an open position, for loading and unloading of goods, but to be movable to a closed position substantially co-planar with the plane of the frame at the end of the container.

The two part off-set portion 23 comprises a first part 26 which extends generally parallel to seating portion 21, but spaced therefrom i.e. stepped with respect to the seating portion 21, to define a shallow recess 27 in which a flange 28 of a T-shaped door edge seal 29 can be received. First part 26 adjoins the seating portion 21 via a neck region 30 of the hinge, and which seats on the face 22 of door 16 via neck contact area 31. Inevitably, with small imperfections in manufacture and assembly, there tend to develop gaps along the interface between neck 30 and door face 22.

The two part off-set portion 23 also includes a second part 32 which extends outwardly away from the first part 26, as can be seen in FIG. 2, and which carries the pivot mounting 24 to provide the off-set hinge axis 25.

In the illustrated embodiment, door 16 is assumed to be made of steel, and therefore hinge 20 will be secured to the door face 22 at a required position adjacent the hinge side 32 of the door 16 by means of a generally U-shaped weld 33 taken along the outer periphery of seating portion 21, as can be seen in FIG. 3.

Regardless of high how the quality of the weld joint 33 which is formed, there will be a risk of moisture ingress to the underside of seating portion 21, especially if there are any gaps in the neck contact area 31. Accordingly, it is a particularly advantageous feature of the embodiment of hinge disclosed herein that a groove 34 is formed in the neck region of the seating portion, and which is open towards the face 22 of the door, and a port 35 is formed in the outer face of the hinge and which communicates with groove 34, whereby a sealant (curable or more usually a non-setting type of sealant) can be injected into the groove 34 from externally of the hinge via the port 35, so as to provide a sealant barrier along the neck region of the hinge.

Therefore, in the arrangement shown in FIGS. 2 and 3, a continuous weld joint 33 is formed around seating portion 21, which forms a curved nose of the hinge, and sealant barrier 36 (see FIG. 2) extends across the underside of the seating portion 21 and overlies the ends of the weld joint 33. Sealant is injected via port 35, and provides a barrier to ingress of moisture coming into contact with the underside of the seating portion. This has the advantage that the structural integrity of the weld joint 33 is not impaired, while a satisfactory sealant arrangement is provided to minimise the risk of moisture penetrating into the interface between seating portion 21 and door face 22.

As shown in FIGS. 2 and 3, port 35 is formed in the seating portion 21, so as to make direct communication with the groove 34, though this is not essential to the invention. What is essential to the invention is that a port or other entry passage or passages is provided in the outer face of the hinge, through which a sealant can be injected from externally of the hinge, and to fill the groove 34.

Returning now to the matter of the door edge seal 28, this is shown in FIG. 2 in an undeformed state, and similarly in FIG. 3, but there is also shown in dashed outline schematically in FIG. 3 one of the upright frame members 13 of the frame defining the loading/unloading opening 12, and cross piece 37 of edge seal 28 can overlie the gap defined between door edge 32 and the inner face of frame member 13 when the door is in the closed position. Further, a deformable lip 38 of door edge seal 28 can be deformed into sealing contact with the inner face of frame member 13 when the door is closed.

Door edge seal 28 therefore will comprise a primary means of sealing the hinge against ingress of moisture to penetrate along the underside of the hinge, and sealant 36 will provide a further barrier.

Figure 5:
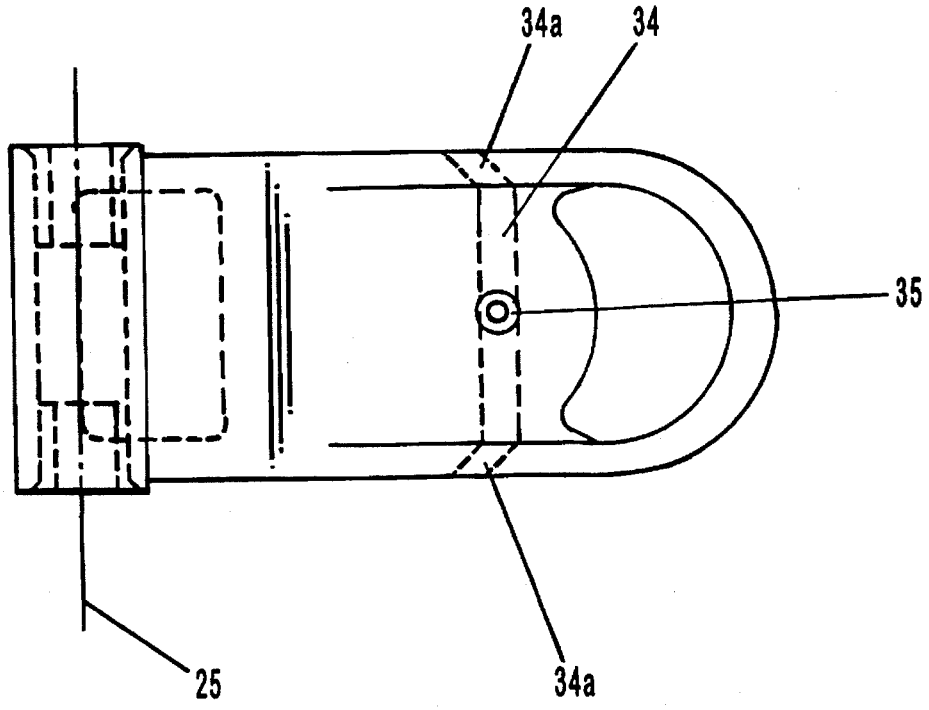
FIG. 5 is a plan view of the hinge shown in FIG. 4.
Figure 6:
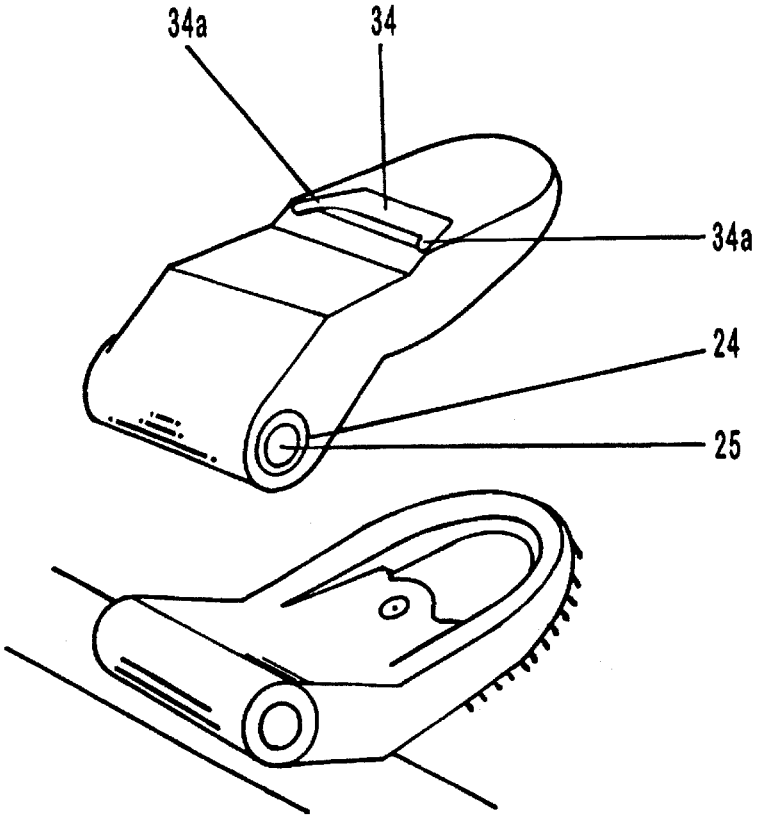
FIG. 6 shows the two opposed faces of the hinge shown in FIGS. 4 and 5; and, FIG. 7 is an end view of the hinge shown in FIGS. 4 to 6.
Figure 7:
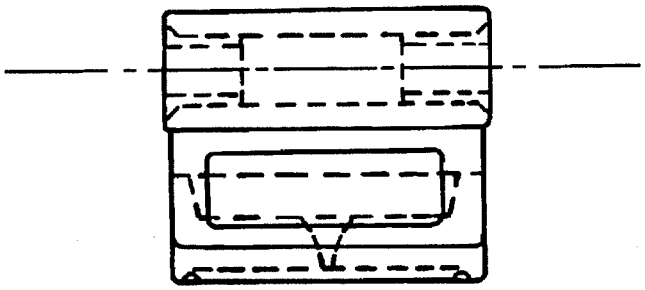

FIGS. 2 and 3 are schematic illustrations only of a construction of hinge for use in a container according to the invention, and FIGS. 4 to 7 show in more detail a practical construction, in which the hinge comprises a steel forging. Parts corresponding with those already described are given the same reference numerals, and will not be described in detail again. However, a particular aspect of the construction shown in FIGS. 4 to 7 is that groove 34 extends outwardly of the port 35, as shown in FIG. 5, and generally parallel to the hinge axis 25 and perpendicular to the general longitudinal extent of the hinge, and then merges into outlet portions 34*a* which extend obliquely in a direction towards the axis 25 and which form outlets at each end of the groove. The purpose of this is so that, following injection of sealant via port 35, which passes into groove 34, the emission of sealant through each outlet end 34*a* will provide assurance that a sufficient amount of sealant has been introduced into the groove, capable of filling the space between the groove and the face 22 of the door.

While the illustrated arrangement provides for welding of the hinge to the door 16, it is within the scope of this invention for the hinge to be bolted in position, which will usually take place when the door is a wooden ply/metal lamination, and the capability of providing sealant barrier 36 in a bolted-on hinge will still provide technical advantage.

I claim:

1. A hinge for pivotally securing a door by the outer face thereof to a container at one side of an access opening thereinto, the container having side walls with the access opening being formed through one of those side walls, and the door being moveable between an open position and a closed position thereof that are within the general plane of the access opening, said hinge comprising:

(a) a seating portion capable of attachment to the outer face of the door and having a neck region;

(b) a two-part offset portion carrying a pivot mounting forming an offset hinge access, said offset portion comprising:

(i) a first part of said offset portion adjoining said seating portion at said neck region thereof, and being stepped with respect to said seating portion, thereby to define between said first part of said offset portion and the outer face of the door, a shallow recess wherein a flange portion of a door edge seal is receivable; and (ii) a second part of said offset portion extending outwardly away from the first part of said offset portion and carrying said pivot mounting;

(c) a container hinge mount attachable to said container, and means for rotatably coupling said container hinge mount to said second part of said offset portion for rotation relative thereto about said pivot mounting;

(d) an open groove formed in said neck region of said seating portion on the side thereof capable of engaging the outer face of the door; and (e) a port formed in the hinge communicating with said groove and opening away from said side of said seating portion capable of attachment to the outer face of the door, said port thereby affording for the injection of a sealant into said groove from externally of said hinge when said seating portion thereof is attached to the outer face of the door, thereby to provide a sealant barrier along said neck region of said hinge.

2. A hinge as recited in claim 1, wherein said seating portion is secured at a required position on the outer face of the door by a welding joint taken along at least the major part of the outer periphery of said seating portion.

3. A hinge as recited in claim 2, wherein said sealant barrier in said groove extends across said side of said seating portion capable of engaging the outer face of the door and overlies the positions of the ends of said weld joint, thereby to provide a barrier against the ingress of moisture into contact with the side of said seating portion that is capable of attachment to the outer face of the door.

4. A hinge as recited in claim 1, wherein said port is in direct communication with said groove.

5. A hinge as recited in claim 1, wherein said groove extends generally parallel to said hinge axis and said injected sealant barrier thereby forms an end closure line on the side of said seating portion capable of engaging the outer face of the door.

6. A hinge as recited in claim 1, further comprising outlets formed through said seating portion communicating with each end of said groove, thereby to permit the emission of sealant therethrough during injection of sealant into said groove through said port.

7. A hinge as recited in claim 1, wherein said shallow recess defined by said first part of said offset portion is capable of housing a flange portion of a door edge seal of generally T-shaped profile mounted along the side of the door adjacent said hinge, thereby to provide a primary barrier against the ingress of moisture into contact with the side of the hinge adjacent the door.

8. A container comprising:

(a) a receptacle having side walls, an access opening at one end of the receptacle, and a generally rectangular frame defining said access opening, said frame comprising:

(i) a pair of upright parallel frame members;

(ii) an upper transversely extending frame member; and (iii) a lower transversely extending frame member;

(b) at lease one door hingedly mounted on a first of said upright frame members for movement between an open position and a closed position, each of said open and closed positions being within the general plane of said frame; and (c) a set of hinges mounted on the outer face of said door near to the side of said door facing said first of said upright frame members, each hinge of said set thereof comprising:

(i) a seating portion engaging and attached to said outer face of said door and having a neck region;

(ii) a two-part offset portion carrying a pivot mounting to form an offset hinge axis, a first part of said offset portion adjoining said seating portion at said neck region thereof and being stepped with respect to said seating portion to define a shallow recess on the underside of said first part of said offset portion, a flange portion of a door edge seal being receivable in said shallow recess, and a second part of said offset portion extending outwardly away from said first part carrying said pivot mounting to provide said offset hinge axis;

(iii) a frame hinge mount attached to said first frame member, and means for rotatably coupling said frame hinge mount to said second part of said offset portion for rotation relative thereto about said pivot mounting;

(iv) a groove formed in said neck region of said seating portion opening toward said outer face of said door; and (v) a port formed in said hinge communicating with said groove and opening away from said outer face of said door, said port thereby affording for the injection of a sealant into said groove from externally of said hinge, thereby to form a sealant barrier along said neck region of said hinge.

9. A container as recited in claim 8, wherein at least one of said hinges is secured at a required position on said outer face of said door by a welded joint along at least the major part of said outer periphery of said seating portion.

10. A container as recited in claim 9, wherein said sealant barrier extends across the underside of said seating portion and overlies the ends of said weld joint, thereby to provide a barrier against the ingress of moisture into contact with the underside of the seating portion.

11. A container as recited in claim 8, wherein said port is in direct communication with said groove.

12. A container as recited in claim 8, wherein said groove extends generally parallel to said hinge axis, and said sealant barrier thereby forms an end closure line of the side of said seating portion engaging said outer face of said door.

13. A container as recited in claim 12, wherein outlets are provided at each end of said groove, thereby permitting the emission of sealant from said outlets during injection of sealant through said port, thereby to verify the complete formation of said sealant barrier.

14. A container as recited in claim 8, further comprising a door edge seal mounted along the hinge side of said door, said seal being of generally T-shaped profile, with a flange portion of said seal being housed within said recess defined between said outer face of said door and said underside of said first part of said offset portion of said hinge, thereby to provide a primary barrier against the ingress of moisture to said underside of the hinge.

15. A container as recited in claim 8, wherein said enclosure has walls comprised of metal, and individual of a pair of doors is each mounted hingedly on a respective one of said upright frame members.

* * * * *